US005102258A

United States Patent [19]

Berger

[11] Patent Number: 5,102,258

[45] Date of Patent: Apr. 7, 1992

[54] ELECTRIC POWERED TROWEL

[75] Inventor: Ronald C. Berger, Clearwater, Fla.

[73] Assignee: Accon, Inc., Clearwater, Fla.

[21] Appl. No.: 628,084

[22] Filed: Dec. 17, 1990

[51] Int. Cl.[5] ..... E01C 19/22

[52] U.S. Cl. ..... 404/97; 404/112

[58] Field of Search ..... 404/97, 112

[56] References Cited

U.S. PATENT DOCUMENTS

| | | | |
|---|---|---|---|
| 2,277,389 | 3/1942 | Conway | 404/112 |
| 2,394,274 | 2/1946 | Troxell | 404/112 |
| 2,662,454 | 12/1953 | Whiteman | 404/122 |
| 2,689,507 | 9/1954 | McCrery | 404/112 |
| 2,888,863 | 6/1959 | Eisenbeis | 404/112 |
| 3,259,033 | 7/1966 | Kelley | 404/112 |
| 3,973,857 | 8/1976 | Whiteman | 404/112 |
| 4,046,483 | 9/1977 | Sutherland | 404/112 |
| 4,629,359 | 12/1986 | Sengupta | 404/112 |
| 4,673,311 | 6/1987 | Whiteman | 404/112 |
| 4,740,348 | 4/1988 | Rose | 404/112 X |

*Primary Examiner*—Thuy M. Bui
*Assistant Examiner*—Roger J. Schoeppel
*Attorney, Agent, or Firm*—Harold D. Shall

[57] ABSTRACT

A lightweight electric trowel having an insulating block disposed in the drive connection between the trowel blades and the motor. The blades are at a fixed angle of four degrees with the leading edge of the blades being inclined at a fifteen degree angle to prevent plowing.

5 Claims, 5 Drawing Sheets

ELECTRIC POWERED TROWEL

BACKGROUND OF THE INVENTION

This invention relates to powered trowels generally and more particularly to a very light weight, insulated electric trowel which may be utilized in conjunction with cement which is still too soft to support the weight of the trowel operator and thereby give faster and superior results.

Concrete finishing machines having been used for many years to level and finish large concrete slabs. Such machines typically have a rotatable trowel blade assembly having a plurality of trowel blades mounted on trowel arms projecting radially outwardly from a common hub with is rotated by a gasoline engine. The trowel blades rest directly on the concrete and support the machine's entire weight. The blades angles are normally, in the prior art, pivotally connected so that when the machine is first being used they are parallel to the concrete surface and as the concrete hardens the blade pitch is progressively increased with the pitch on the final pass being as much as 30 degrees. These machines weigh as much as 125 pounds and the operator must wait until the concrete is partially set up before he walks on the surface and takes the machine with him.

SUMMARY OF THE INVENTION

In the instant invention, the machine is very light weight, weighing approximately 58 pounds and requires only a small one-sixth horse power motor to drive the trowel blades. The operator controls the machine with a 20 foot pole so there is no necessity for him to walk on the concrete surface to operate the machine. The machine as its trowel blades set at a fixed 4 degree angle and need not be adjusted to provide for weight support and finishing. The motor is also variable speed so that the blades can be rotated at approximately 75 to 250 R.P.M. to start and finish the troweling operation. As compared to heavy finishing machines, there is less friction on the trowel blades due to finishing the cement when it is wetter with the light weight machine. Additionally, the fixed 4 degree angle blade of this invention reduces friction substantially. Further, since the blades are at a fixed 4 degree angle, stabilizing brackets can be used to connect the blades and keep them stable.

DETAILED DESCRIPTION

Figure 1:
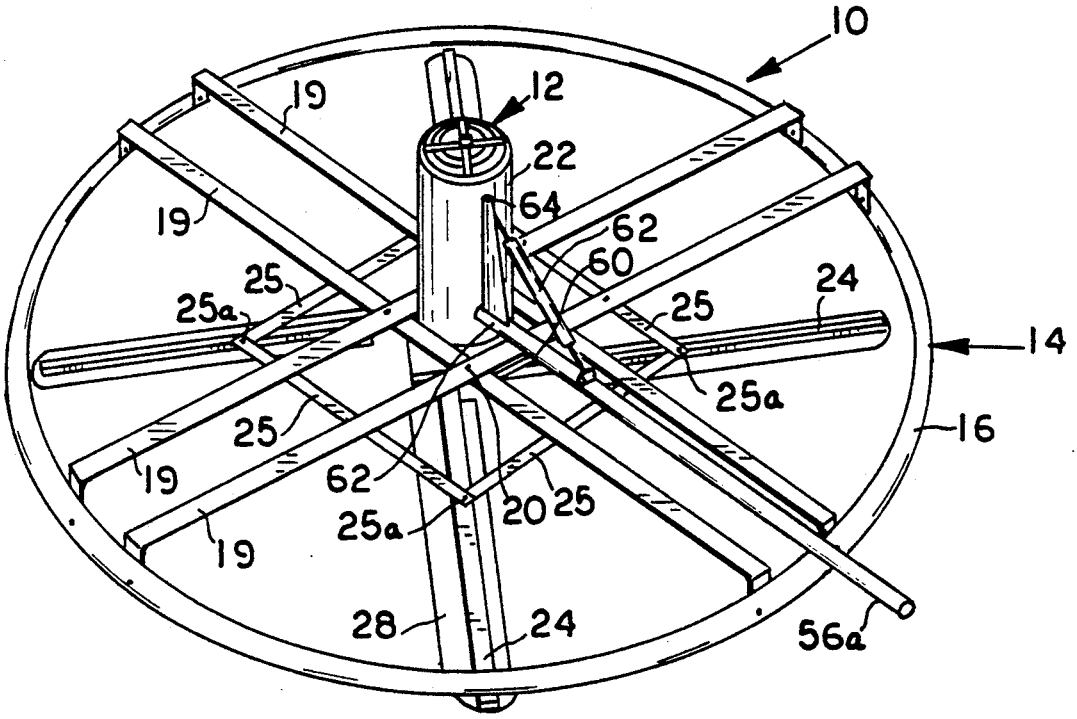
FIG. 1 is a perspective view of an electric powered trowel according to this invention.

Referring now to the drawings, the electric powered trowel is shown generally at 10 and includes a light weight electric motor 12 for driving the trowel and rotating the various elements thereof as hereinafter described.

The electric motor has non-rotatably secured thereto a conventional guard ring 14, which ring includes an annular member 16 interconnected by four cross bars 19. The cross bars 19 are connected to a guard plate 18 (see FIG. 2) as by a plurality of screws 20; the guard plate forming the lower end of the housing 22 of the motor 12.

Figure 2:
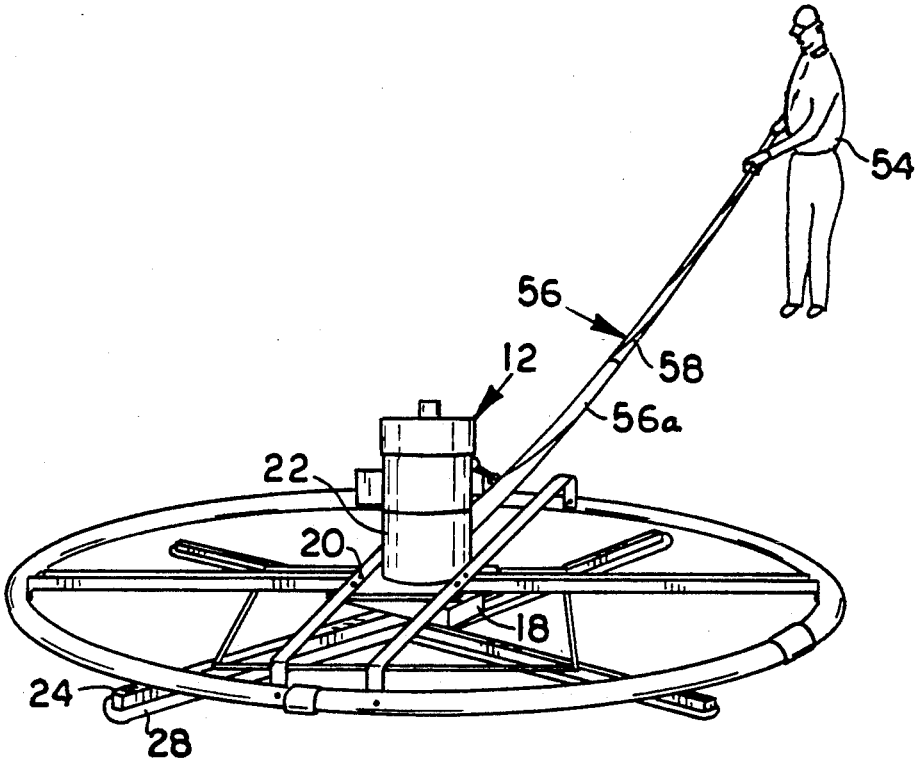
FIG. 2 is a perspective view of the trowel of FIG. 1 being held by an operator.
Figure 4:
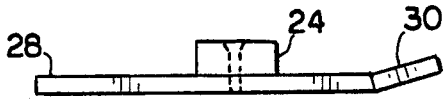
FIG. 4 is an end view of the device of FIG. 3.
Figure 3:
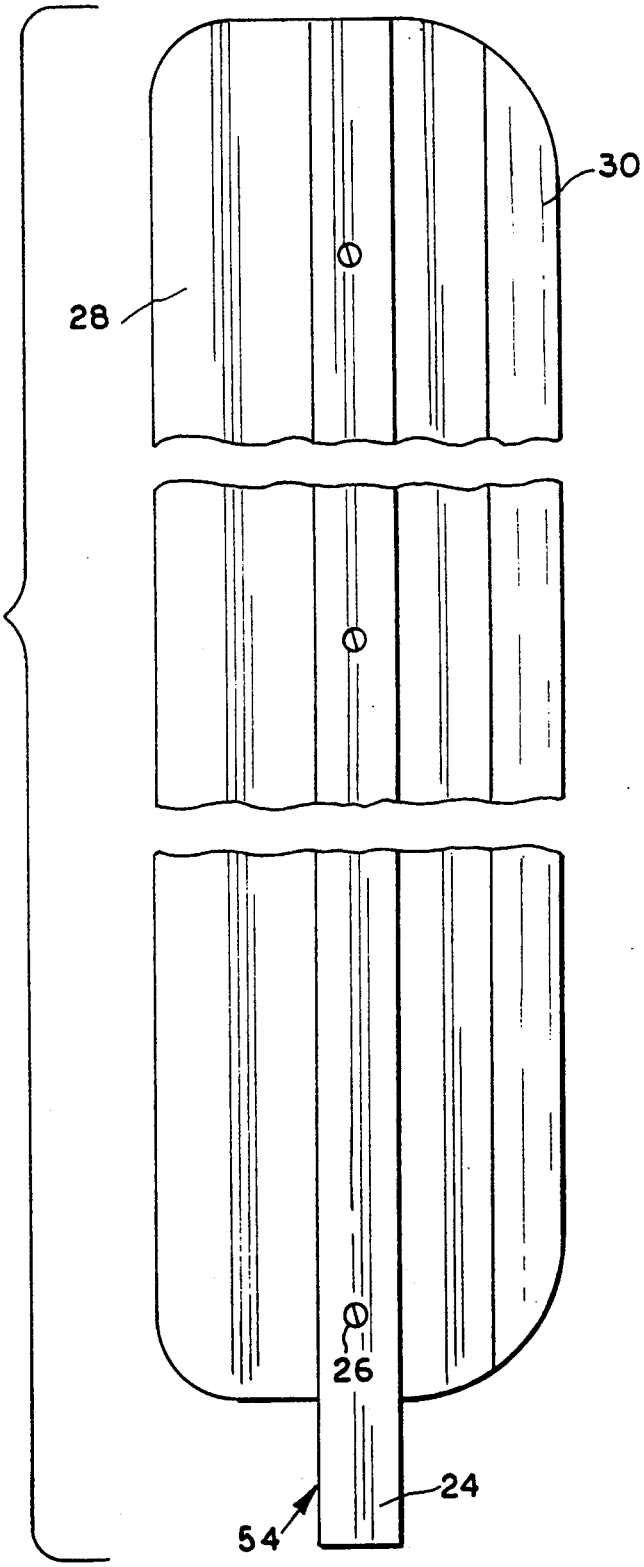
FIG. 3 is a plan view of a spring steel blade with a blade are secured thereto.

As seen in FIGS. 1, 2 and 3 four blade arms 24 each having conventionally secured thereto as by a plurality of screws 26 (see FIG. 3) a spring steel blade 28. The motor rotates the blade assembly (hereinafter more fully described) in a clockwise direction. Accordingly, as clearly seen in FIGS. 3 and 4, the leading edge 30 of the steel blade is inclined at a 15 degree angle to inhibit plowing of the leading edge into the concrete being troweled, particularly when the concrete is still quite wet and soft.

Figure 6:
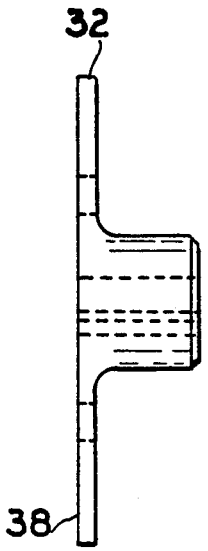
FIG. 6 is a side view of the plate of FIG. 5.
Figure 5:
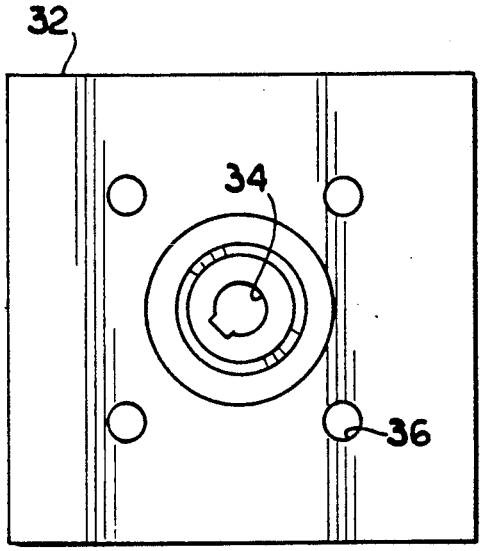
FIG. 5 is a plan view of the motor shank plate.
Figure 7:
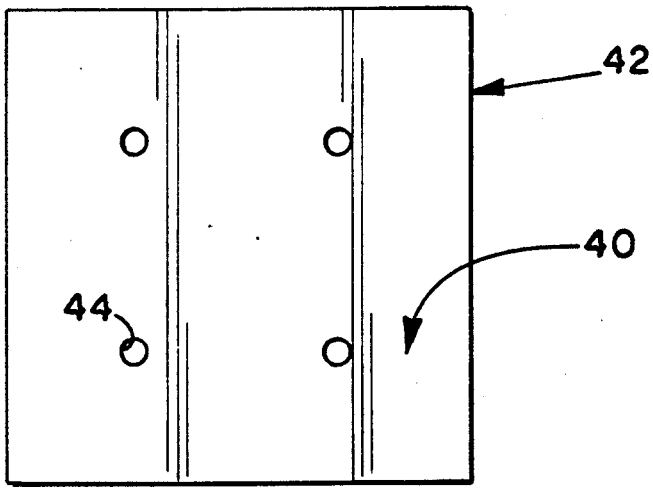
FIG. 7 is a plan view of the insulating base plate.

The motor 12 has a conventional keywayed output shaft (not shown) projecting from the lower end of the guard plate 18, and referring to FIGS. 5 and 6, keyed on the end of the output shaft is a motor shank plate 32 having a keyed central bore 34 which is keyed to the lower end of the output shaft in a conventional manner. The shank plate has four equally spaced bolt holes 36 therein for receiving the shank end of conventional insulating nylon mounting bolts (not shown).

Immediately below and abutting the lower side 38 of the shank plate with its upper side 40 is an insulating plate 42 which insulates the remaining lower portions of the machine 10 from the electric motor 12. The insulating plate 42 has four bolt holes 44 in registration with the bolt holes 36.

Figure 8:
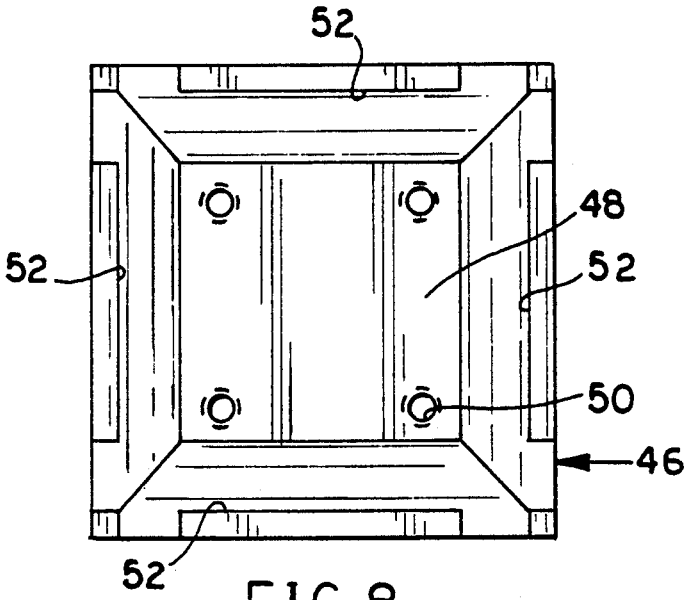
FIG. 8 is a plan view of the base plate.
Figure 9:
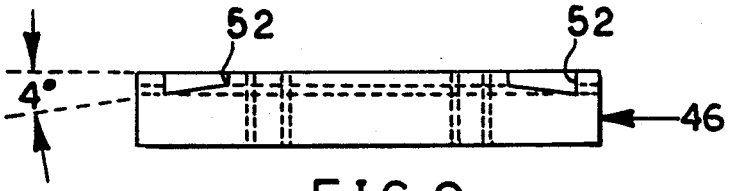
FIG. 9 is an end view of the base plate showing two 4 degree angle slots to receive the blade arms.

Referring now to FIGS. 8 and 9, base plate 46 is shown and its upper side 48 is immediate below and abutting the lower side of the insulating plate 42. The base plate 46 has four threaded openings 50 for receiving the lower ends of the insulating nylon bolts (not shown). The base plate 46 is square when viewed in FIG. 8 and adjacent and parallel to each edge is a slot 52 which is disposed at a 4 degree angle. The inner ends 54 of the blade arms (see FIG. 3) are each received in one of the slots 52 are welded therein such that the leading edges 30 of the blades 28 face clockwise. Each of the blade arms 24 is connected to an adjoining blade arm by a stabilizing bracket 25 by a bolt **25*a*** so as to make the blade assembly very rigid.

Referring now to FIGS. 1 and 2, the operator 54 of the trowel 10 stands at a distance from the towel and manipulates the same by a control arm 56. The control arm 56 is made up of a plurality of interfitting sections **56*a* so that the length thereof can be varied. For doing driveways and large slabs, an ideal length is twenty feet. The electric cord 58 is wrapped around the control arm 56** to keep the same from dragging in the cement.

The distal end 60 of the distal section **56*a* of the arm 56 is pivotally connected to the motor housing 22 by a bolt 62, while a turnbuckle 62 is connected to the upper end of the motor housing 22 by bolt 64 and to the section 56*a* adjacent the distal end thereof. In this manner adjusting the length of the turnbuckle 62, adjusts the angle of the control arm 56 relative to the electric motor 12**.

Since the motor is turning clockwise, if the operator 54 lifts the end of the control arm 56, the trowel 10 will move to the right, while if the operator lowers the control are 56 the trowel will move to the left moving the trowel 10 fore and aft is accomplished by pushing and pulling the control arm 56.

The blades are ideally approximately 20 inches long and 5½ inches wide making the area thereof one hundred and ten square inches and the four blades, four hundred and forty square inches, thereby making a weight to area ratio of 58:440 or 29:220 which is extremely favorable and allows the trowel to be operated on the wet cement before it has had to have time to start to harden. Because of the light weight and long control arm 56, the operator 54 need not wait for the cement to harden and support his weight so he can walk on the cement while he is troweling the same.

Although the above description relates to a presently preferred embodiment, numerous changes can be made therein, without departing from the scope of this invention as defined in the following claims.

What is claimed is:

1. An electric powered trowel comprising in combination, a) a light weight electric motor having a housing, b) a guard plate forming the lower end of said housing, c) a guard ring fixedly secured to said guard plate, d) a shank plate disposed below said guard plate and keyed to and rotated by said electric motor, e) an insulating plate secured to the bottom of said shank plate, f) a base plate secured to the bottom of said insulating plate and insulated from said shank plate and electric motor, g) said base plate being square when viewed from above and having a slot formed adjacent and parallel to each edge thereof so that there are four slots, h) said slots being positioned at a 4 degree angle to the horizontal, i) a blade arm being secured in each of said slots, a spring steel blade being secured to the bottom of each of said blade arms at a fixed angle relative to said arm and said motor.

2. An electric powered trowel according to claim 1 including four stabilizing brackets with each bracket connecting and stabilizing an adjacent pair of blade arms.

3. An electric powered trowel according to claim 1 wherein the weight to area ratio of said trowel to the steel blades is approximately 29:220.

4. An electric powered trowel according to claim 1 wherein the leading edge of each of said steel blades is angled at fifteen degrees thereby to prevent plowing into wet cement.

5. An electric powered trowel according to claim 2 wherein the leading edge of each of said steel blades is angled at fifteen degrees thereby to prevent plowing into wet cement.

* * * * *